US005484149A

United States Patent [19]

Lee

[11] Patent Number: 5,484,149

[45] Date of Patent: Jan. 16, 1996

[54] ADJUSTABLE ROLLER SKATE STRUCTURE

[75] Inventor: Fang-Liang Lee, Chung, Taiwan

[73] Assignee: Yuh Jou Co., Ltd., Taipei, Taiwan

[21] Appl. No.: 258,084

[22] Filed: Jun. 10, 1994

[51] Int. Cl.[6] ..... A63C 17/04

[52] U.S. Cl. ..... 280/11.26; 280/11.27; 280/11.22

[58] Field of Search ..... 280/11.19, 11.22, 280/11.23, 11.26, 11.27

[56] References Cited

U.S. PATENT DOCUMENTS

| | | | |
|---|---|---|---|
| 1,807,890 | 6/1931 | Berger | 280/11.25 |
| 3,635,854 | 8/1969 | Martin | 280/11.26 |
| 4,684,140 | 8/1987 | Olivieri | 280/11.26 |
| 4,708,352 | 11/1987 | Vullierme | 280/11.26 |
| 5,224,718 | 7/1993 | Gertler | 280/11.26 |
| 5,295,701 | 3/1994 | Reiber et al. | 280/11.26 |

*Primary Examiner*—Richard M. Camby
*Attorney, Agent, or Firm*—Bacon & Thomas

[57] ABSTRACT

An adjustable roller skate structure in which the front portion of the shoe ridge is secured to the front body and a longitudinal tooth track is provided on the top surface of the shoe ridge. Two edges on the sides of the shoe ridge are provided with guided track for the left and the right rear bodies to be inserted thereto and moved along. When the left and right rear bodies are put together, a latching block is pivotally connected between the top surface and the lower end of the rear casing. The latching block works like a seesaw and the pivotal pin of the latching block is parallel to the shoe ridge. The bottom surface of the latching block is also provided with a plurality of teeth for selectively engaging the tooth track of the shoe ridge. A user presses on the latching block from a hole in the rear casing so that the end with the tooth is raised up, thereby allowing the rear bodies to move along the guided track for adjustment, so as to adapt the skate to the size of the user.

2 Claims, 3 Drawing Sheets

ADJUSTABLE ROLLER SKATE STRUCTURE

BACKGROUND OF THE INVENTION (a) Field of the Invention

The present invention relates to an adjustable roller skate structure, particularly to a new design structure in which the front and the rear bodies of the roller skate can be adjusted easily.

(b) Description of the Prior Art

The roller skates available nowadays have their front and their rear bodies attached to the forward and the rearward ends of a shoe ridge. The side edges of the front and the rear bodies are provided with a plurality of holes, one of which is used to line up with a hole in a row of holes on the side of the shoe ridge, so that a bolt can be used to secure the front and the rear bodies together. This adjustment is troublesome, particularly to a growing teenager or to a person wearing another pair of shoes. These circumstances require that adjustments be made. Each requires that the bolts be taken down and the roller skate bodies be lined up and re-bolted before the skates can be used. The adjustment process is time consuming. Moreover, it is awkward for the user to carry the tools required for adjustment. Therefore, it can be seen that the conventional adjustment structures are impractical.

SUMMARY OF THE INVENTION

It is a main object of the invention to provide an adjustment structure for a roller skate in which the front body of the roller skate is attached to the forward end of the shoe ridge. A tooth track is provided on the top surface and guided tracks are provided on the side of the shoe ridge. When the left and right rear bodies are put together, a latching block is provided and is pivotally connected between the top surface and the lower end of the rear casing. The latching block works like a seesaw and the pivotal pin of the latching block is parallel to the shoe ridge. The bottom surface of the latching block is also provided with a plurality of teeth for cooperating with the tooth track of the shoe ridge. By such configuration, a user presses on the latching block from a hole in the rear casing so that the end with the tooth is raised up, thereby allowing the rear bodies to move along the guided track for adjustment, so as to adapt the skate to the size of the user. It is an adjustable roller skate structure which is simple to adjust and easy to use.

BRIEF DESCRIPTION OF THE DRAWINGS

The drawings disclose an illustrative embodiment of the present invention which serves to exemplify the various advantages and objects thereof, and are as follows.

DETAILED DESCRIPTION OF THE PREFERRED EMBODIMENT

Figure 1:
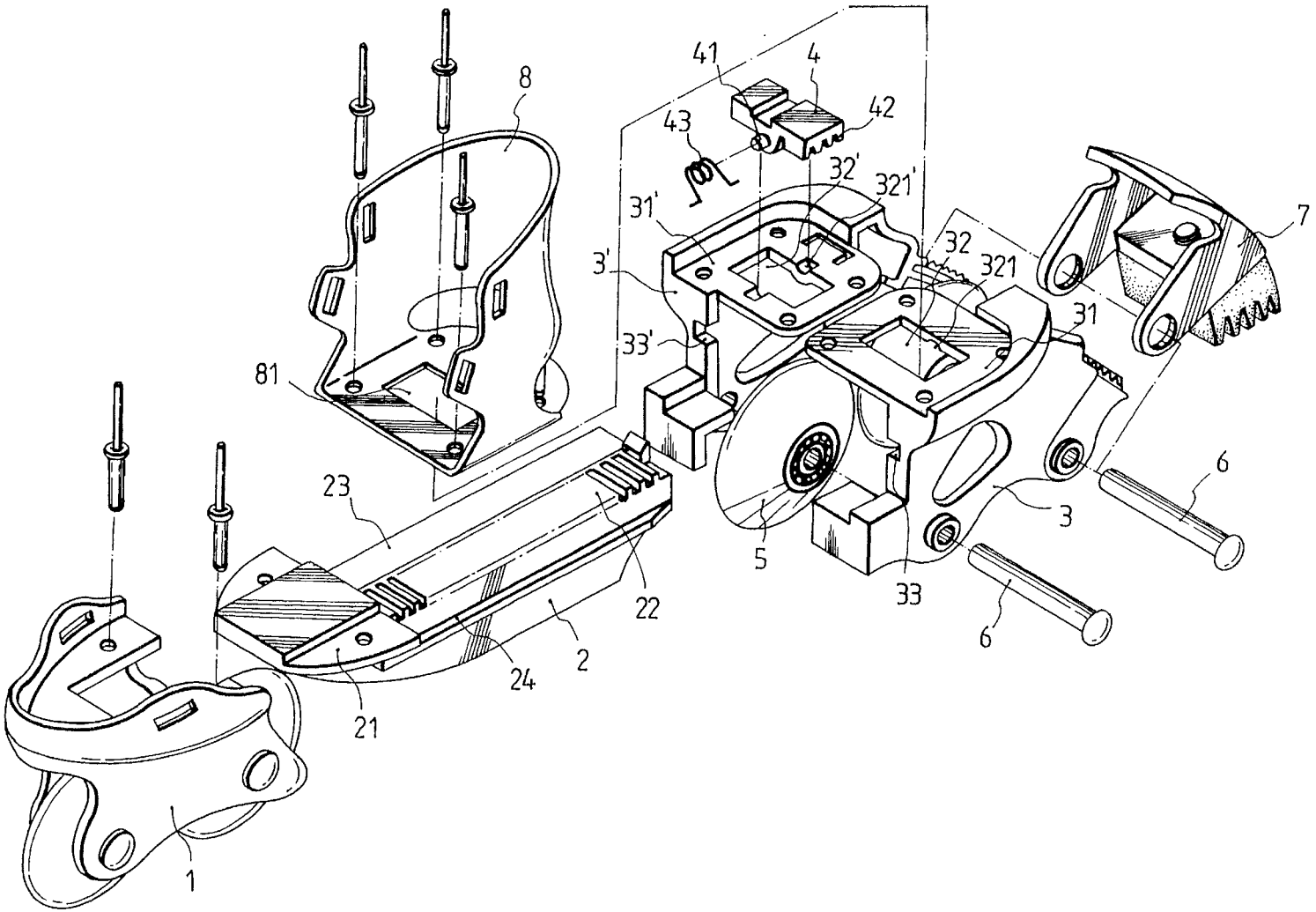
FIG. 1 is a perspective exploded view of the adjustable roller skate according to the present invention.
Figure 2:
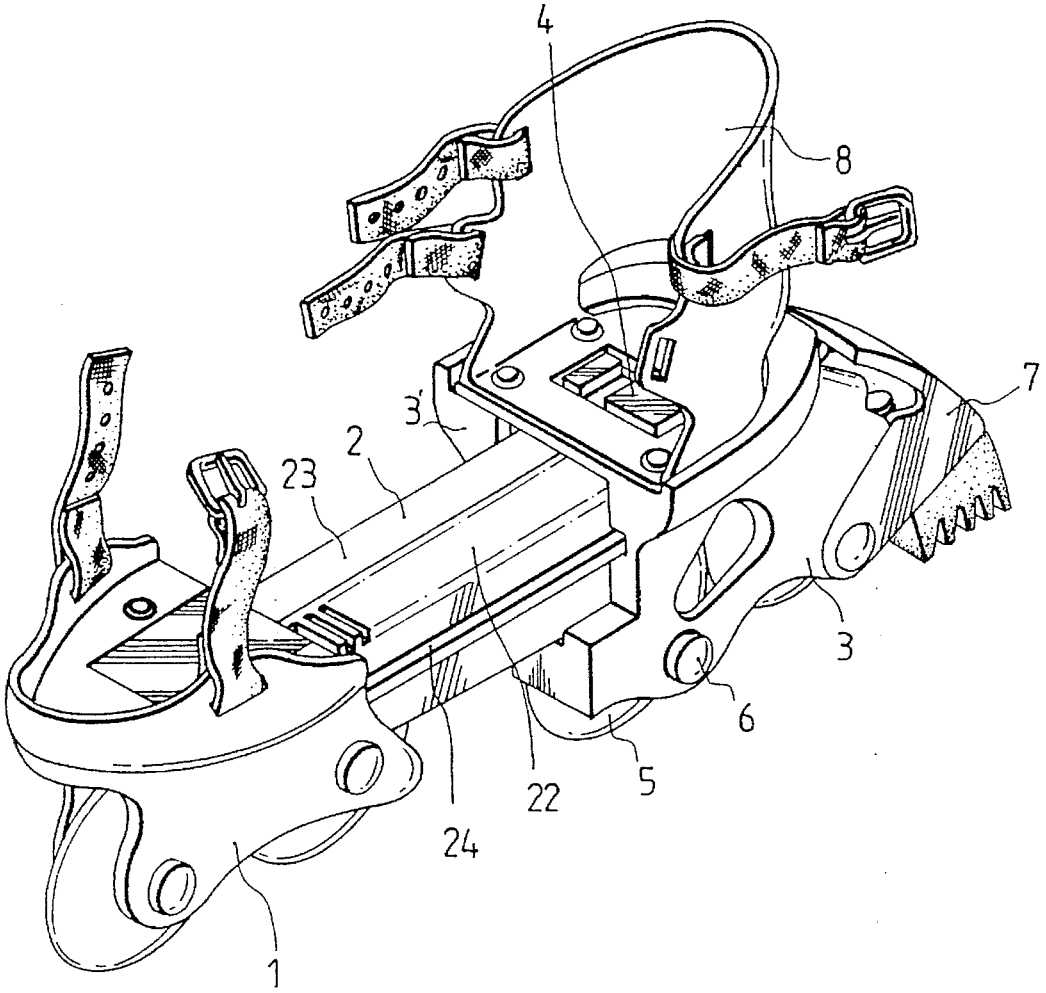
FIG. 2 is a perspective view of an assembled adjustable roller skate according to the present invention.

As shown in FIGS. 1 and 2, the adjustable structure of the roller skate according to the present invention mainly consists of a front body (1), a shoe ridge (2), a pair of left and right rear bodies (3) and (3'), a latching block (4), two pair of rollers (5), for the front and rear bodies (1, 3, 3') two axles (6), pairs of rollers (5), a brake pad (7) and a rear casing (8). The front body (1), the rollers (5), the axles (6) and the brake pad (7) are of conventional design. The shoe ridge (2) is a substantially rectangular strip having a connecting portion (21) at its front end for connecting to the front body (1). One side of the top surface of the shoe ridge (2) is provided with a tooth track (22) which is arranged in the longitudinal direction. The other side of the top surface is a recessed surface (23). The two side edges of the shoe ridge (2) are each provided with an outwardly extending guide track (24). The left and the right rear bodies (3) and (3') are provided with corresponding engaging structure. Recessed surfaces (31) and (31') provided in the top surface of the rear bodies (3) and (3') coincide with each other. The center of the recessed surfaces (31) and (31') are provided with holes (32) and (32'), the front and rear central portion of which are provided with slots (321) and (321'). The edges of the rear bodies (3) and (3') are provided with guided-track slots (33) and (33'). The latching block (4) has a pivotal pin (41) at its center, one side of the bottom surface is raised and the other side of the same surface has a plurality of teeth (42) to cooperate with the tooth track (22). The rear casing (8) is provided with a hole (81) at the center of its bottom surface. The hole (81) is provided so that a user can access the latching block (4).

Figure 3A:
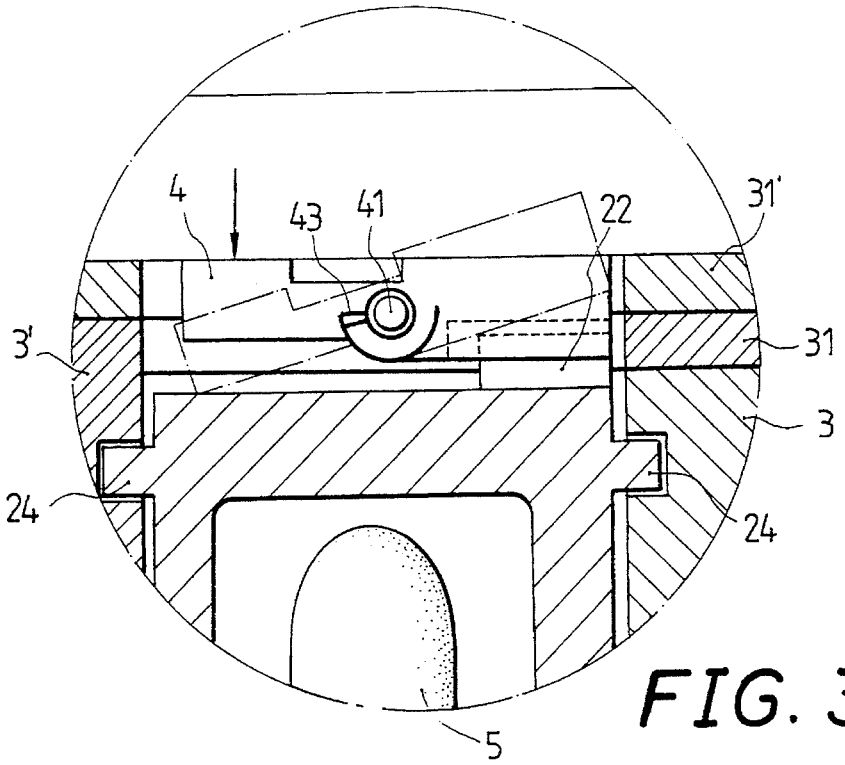
FIG. 3 is a sectional view of the roller portion according to the present invention.
Figure 3:
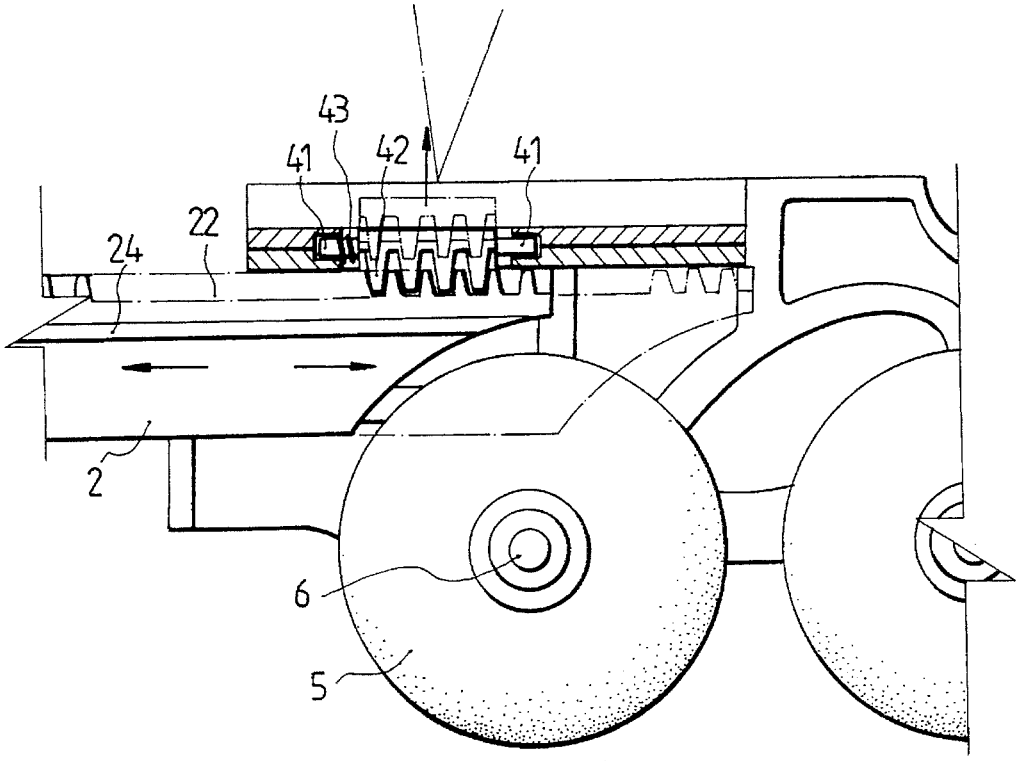

By the above configuration, the connecting portion (21) at the front end of the shoe ridge (2) is connected to the front body (1). The latching block (4) is disposed in the lateral direction in the hole (32') of the recessed surface (31') of the rear body (3') so that the pivotal pin (41) of the latching block (4) is fitted into the slot (321'). One end of the pivotal pin (41) is provided with a torsional spring (43), the left and the right rear bodies (3) and (3') are then put together. The recessed surface (31) on the top coincides with the recessed surface (31') on the bottom, thus the latching block (4) is clamped together inside the holes (32) and (32'). At the same time, the two rollers (5) are installed in the rear bodies (3) and (3') by the use of the two axles (6), the brake pad (7) is then installed at the rear ends of the rear bodies (3) and (3'). The rear casing (8) is then secured in the recessed surfaces (31) and (31'), the shoe ridge (2) is inserted into the holes of the assembled left and right rear bodies (3) and (3'). The protruded guided tracks in the two sided edges of the shoe ridge (2) are engaged with the guided-track slots (33) and (33'). The latching block (4) must be pressed down at one end (the bottom of the end without the teeth) so that the other end with the teeth (42) is raised up out of engagement with the tooth track (22), as shown in FIG. 3. While the latching block (4) is continued to be pressed down, the rear bodies (3) and (3') can be adjusted freely along the shoe ridge (2) so as to adapt to the needs of the users. The overall structure is simplified and the adjustment is easy, thereby giving an adjustable roller skate that is advanced in design and practical to be used.

Although the invention has been described in its preferred form with a certain degree of particularity it is understood that the present disclosure of the preferred form has been made only by way of example and numerous changes in the details of construction and the combination and arrangement of parts may be resorted to without departing from the spirit and the scope of the invention as hereinafter claimed. It is intended that the patent shall cover, by suitable expression in the appended claims, whatever features of patentable novelty exists in the invention disclosed.

What is claimed is:

1. An adjustable roller skate structure of the type including a front body with a roller and axle assembly, a rear body with a roller and axle assembly, a shoe ridge connecting the front and rear bodies together and having a top surface and a pair of side edges, a rear casing and a brake pad mounted on the rear body, the improvement comprising:

a) the shoe ridge including a tooth track on the top surface and a guide track extending outwardly from each side edge;

b) the rear body including a left body portion and a right body portion of corresponding configurations, each body portion including a recessed top surface having a central hole therethrough, the body portions being disposable in overlapping coincidence with each other to position the holes in alignment, and each body portion further including a slot for engagement by the guide tracks of the shoe ridge;

c) a latching block disposed within the aligned holes of the body portions and clamped therebetween for pivotal movement, the latching block including a surface defined by a plurality of teeth for engaging the tooth track of the shoe ridge, and means for biasing the teeth of the latching block into engagement with the tooth track;

d) the rear casing including a hole through a bottom surface thereof, the latching block being accessible through the hole; and e) whereby when the latching block is pivoted against the biasing means, the teeth are disengaged from the tooth track to permit the shoe ridge to be adjusted relative to the rear body and thereafter secured in the desired position of adjustment by releasing the latching block.

2. The adjustable roller skate structure of claim 1 wherein the recessed surface of each rear body portion is provided with a pair of opposed slots at the periphery of the hole;

a) the latching block includes a central pivotal pin provided with opposed ends clamped between the opposed slots of the recessed surfaces; and b) the biasing means includes a torsional spring mounted on one end of the pivotal pin.

* * * * *